US005461961A

United States Patent [19]

Baus; Rüdiger et al.

[11] Patent Number: 5,461,961

[45] Date of Patent: Oct. 31, 1995

[54] COMBAT VEHICLE AND SYSTEM FOR TRANSPORTING IT FOR LOADING ONTO AIRCRAFT

[75] Inventors: Rüdiger Baus, Vellmar; Reiner Linge, Kassel, both of Germany

[73] Assignee: Firma Wegmann & Co. GmbH, Kassel, Germany

[21] Appl. No.: 361,267

[22] Filed: Dec. 21, 1994

[30] Foreign Application Priority Data

Jan. 20, 1994 [DE] Germany ..... 44 01 587.9

[51] Int. Cl.[6] ..... F41F 3/04; F41A 23/34

[52] U.S. Cl. ..... 89/1.815; 89/40.03; 89/40.14; 89/37.13

[58] Field of Search ..... 89/40.01, 40.13, 89/40.14, 40.03, 40.08, 1.811, 1.815, 37.13

[56] References Cited

U.S. PATENT DOCUMENTS

| | | | |
|---|---|---|---|
| 1,861,831 | 6/1932 | Barnes | 89/40.13 |
| 2,977,857 | 4/1961 | Carlberg | 89/40.01 |
| 3,242,813 | 3/1966 | Carlsson | 89/40.01 |
| 3,379,097 | 4/1968 | Fisher | 89/1.815 |
| 4,166,406 | 9/1979 | Maughmer | 89/1.815 |
| 4,302,666 | 11/1981 | Hawkins | 89/1.815 |
| 4,583,444 | 4/1986 | Jackson | 89/40.03 |
| 4,686,888 | 8/1987 | Sanborn et al. | 89/40.03 |

*Primary Examiner*—Charles T. Jordan
*Assistant Examiner*—Theresa M. Wesson
*Attorney, Agent, or Firm*—Sprung Horn Kramer & Woods

[57] ABSTRACT

A combat vehicle with a driver's cab mounted on its chassis along with a weapon incorporating a rocket launcher, wherein the rocket launcher rests on a carriage and is elevated and leveled by electrically powered mechanisms between it and the carriage, and the carriage pivots in azimuth on an intermediate structure that rotates on a collar on the chassis. The weapon is an independent assembly incorporating the rocket launcher, the carriage, the intermediate structure, and the collar and is attached to the chassis only by a mount, and by electrical connections if any, accessible from outside the vehicle. To load the motor vehicle onto aircraft, the rocket launcher is rotated at elevation 0° into a position 90° to the length of the vehicle. A carrier that travels on at least three wheel-mounted upright rack-and-pinion mechanisms is advanced over the vehicle to above the weapon, the weapon is attached to the carrier, the weapon is detached from the chassis by releasing the mount and by disconnecting any electrical connections, the rack-and-pinion mechanisms lift the weapon, the chassis is removed, the rack-and-pinion mechanisms lower the weapon to carrying height, the weapon is carried onto the aircraft by the carrier, and the chassis is loaded onto another aircraft.

8 Claims, 12 Drawing Sheets

COMBAT VEHICLE AND SYSTEM FOR TRANSPORTING IT FOR LOADING ONTO AIRCRAFT

BACKGROUND OF THE INVENTION

The invention concerns a combat vehicle with a driver's cab mounted on its chassis along with a weapon incorporating a rocket launcher. The rocket launcher rests on a carriage and is elevated and leveled by electrically powered mechanisms between it and the carriage. The carriage pivots in azimuth on an intermediate structure that rotates on a collar on the chassis. The invention also concerns a system for loading the vehicle onto aircraft.

There is a drawback to combat vehicles of this type. The vehicle and the launcher together are too heavy for a conventional aircraft to carry, and it can accordingly not be shipped rapidly to remote destinations.

Attempts have been made to reduce weight by removing the rocket launcher and shipping it separately from the vehicle. There are, however, two substantial drawbacks to this approach. First, the rocket launcher is considerably lighter than the vehicle, so that the weight is not evenly divided. Second, removing the rocket launcher is complicated, even more so because, since the elevating-and-leveling mechanisms must be disconnected, the vehicle and launcher and its elevating-and-leveling mechanisms need to be reassembled and recalibrated on arrival, which takes considerable time and labor.

SUMMARY OF THE INVENTION

One object of the present invention is an improved combat vehicle of the type with a driver's cab mounted on its chassis along with a weapon incorporating a rocket launcher, wherein the rocket launcher rests on a carriage and is elevated and leveled by electrically powered mechanisms between it and the carriage, and the carriage pivots in azimuth on an intermediate structure that rotates on a collar on the chassis.

Another object is the system for loading such a vehicle onto aircraft. The weights of the launcher and vehicle in accordance with the present invention will be equally distributed for loading. The launcher itself will be particularly easy to load. Finally, the reassembled vehicle and launcher and its elevating-and-leveling mechanisms will not need to be recalibrated.

The first object is attained in accordance with the present invention in a combat vehicle of the aforesaid type wherein the weapon is accordingly an independent assembly incorporating the rocket launcher, the carriage, the intermediate structure, and the collar, and its weight more closely approximates that of the vehicle itself. This weapon is attached to the chassis only by a mount, and by electrical connections if any, accessible from outside the vehicle.

The second object is attained in accordance with the present invention in a system wherein the weapon and the chassis are accordingly loaded onto separate aircraft in the sequence that will now be described. The rocket launcher is rotated at elevation 0° into a position 90° to the length of the vehicle. A carrier that travels on at least three wheel-mounted upright rack-and-pinion mechanisms is advanced over the vehicle to above the weapon. The weapon is attached to the carrier. The weapon is detached from the chassis by releasing the mount and by disconnecting any electrical connections. The rack-and-pinion mechanisms lift the weapon. The chassis is removed. The rack-and-pinion mechanisms lower the weapon to carrying height. The weapon is the carried onto the aircraft by the carrier. The chassis is then loaded onto another aircraft.

The carrier employed with one particularly advantageous embodiment of the system comprises an upper section that rests on a lower section and at least three wheel-mounted upright rack-and-pinion mechanisms. The upper section comprises at least one longitudinal strut and one transverse strut. The weapon is suspended for carrying from the upper section by fasteners. The lower section comprises at least two longitudinal struts and two transverse struts and stabilizes the carriage while the weapon is being carried. The upper section travel up and down on the lower section on the rack-and-pinion mechanisms. The whole carrier travels on the sets of wheels the mechanisms are mounted on.

Further advantageous advanced embodiments of the carrier are disclosed hereinafter.

One basic concept of the present invention is the unique displacement of the interface between the vehicle and what constitutes the weapon. It is not, in contrast to known approaches, only the rocket launcher that is removed but a total assembly comprising carriage, intermediate structure, and collar, along with the mechanisms that elevate the launcher. The interface is situated where it can be disestablished by releasing a weapon mount accessible from outside the vehicle. Once any electrical connections have been disconnected, the whole weapon can be lifted off the vehicle's chassis. The system for loading the vehicle is specifically adapted to this design. Its most important component is the carrier, which is similar to the carriers employed to move and load containers. The carrier in accordance with the present invention, however, is specifically adapted for the problems that occur in lifting a weapon off a chassis and carrying it onto an aircraft, substantially simplifying the procedure.

Embodiments of the present invention will now be specified with reference to accompanying drawing, wherein:

Figure 3:
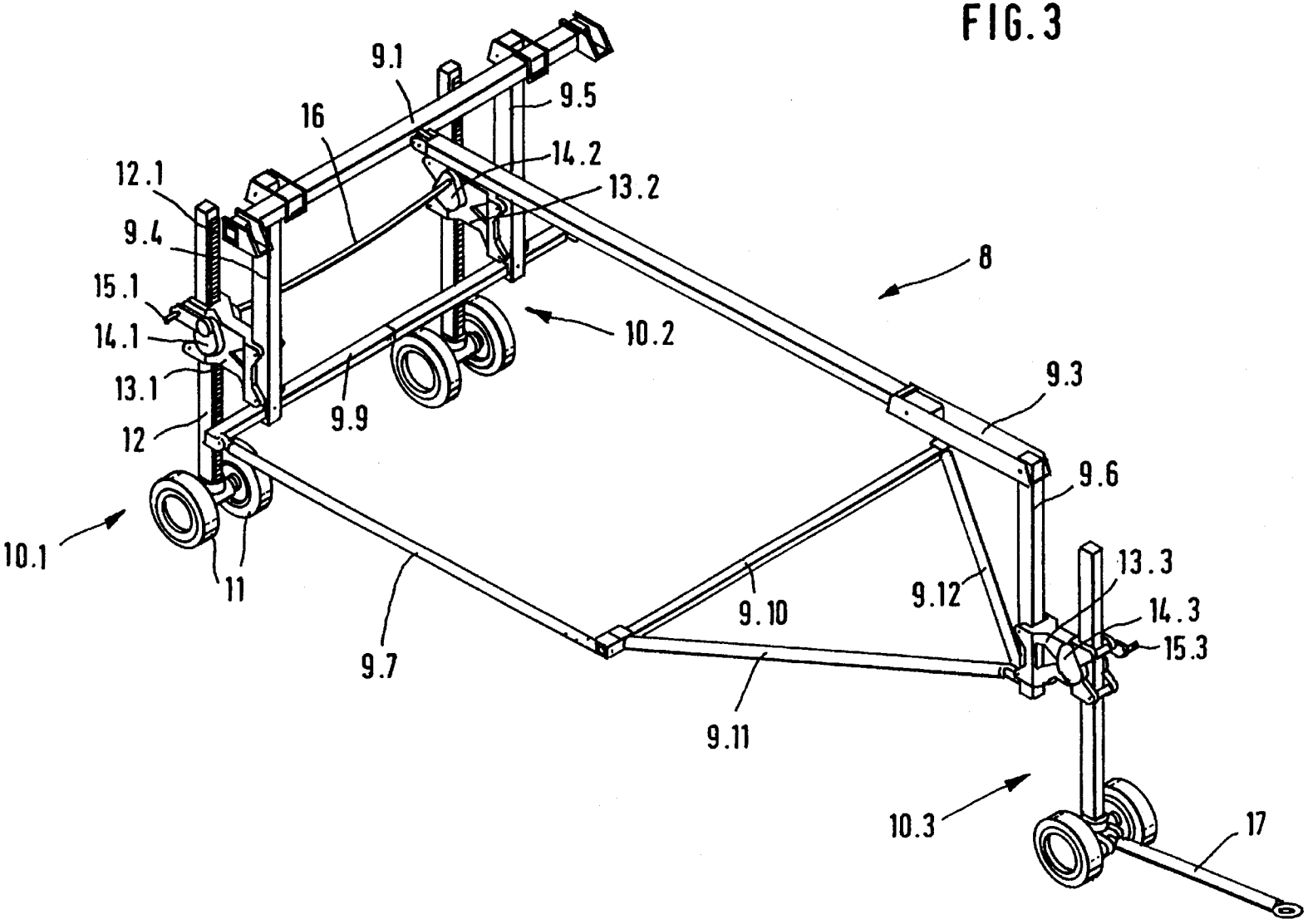
FIG. 3 is a perspective view from a forward angle of a carrier for loading the weapon illustrated in FIGS. 1 and 2.
Figure 9:
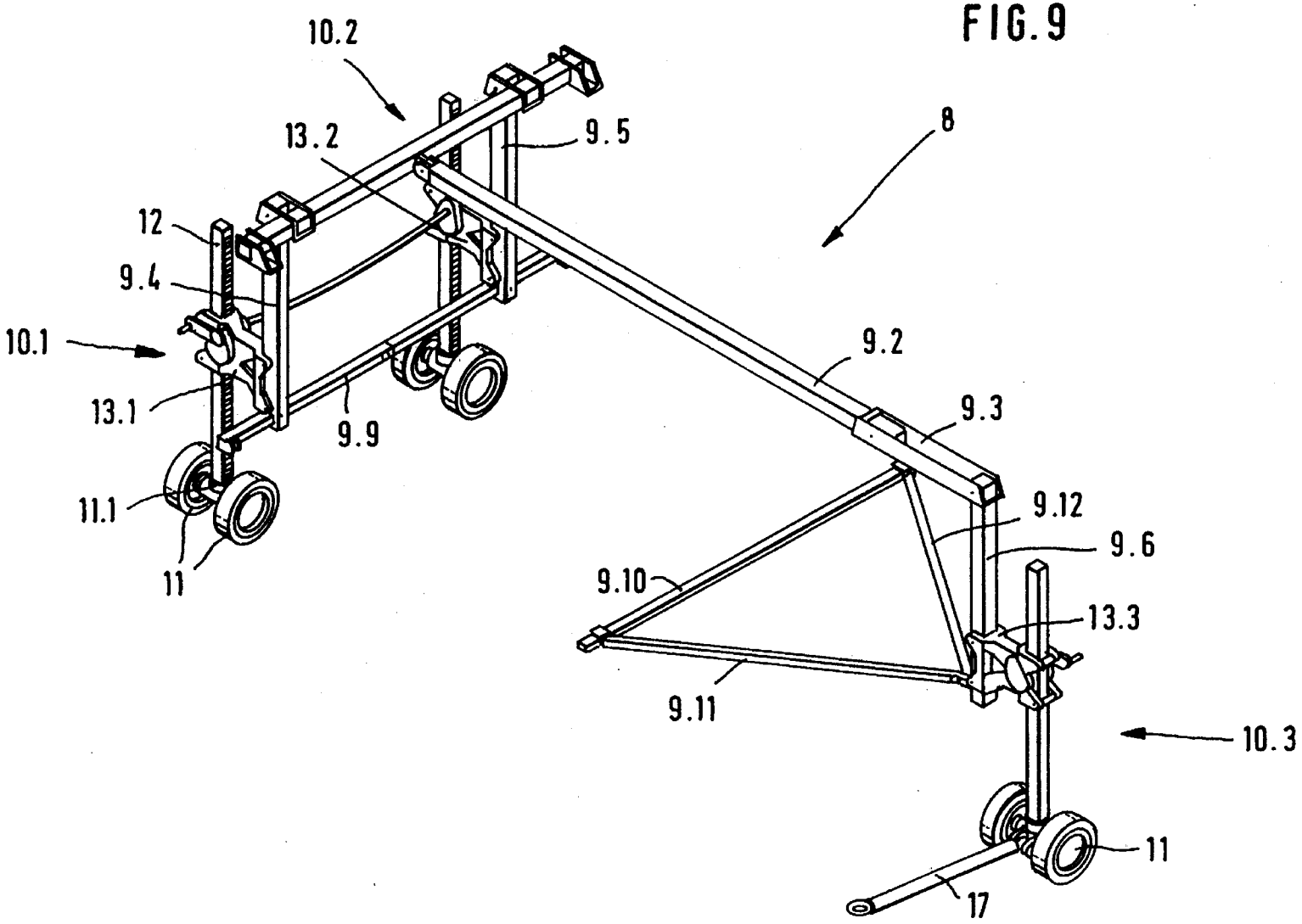

5,

FIG. 9 is a view similar to that in FIG. 3 but illustrating the carrier ready to be advanced over the vehicle.

DETAILED DESCRIPTION OF THE INVENTION

FIGS. 1, 1A–F and 2 illustrate a combat vehicle and component thereof. A cab 2 is mounted on a chassis 1 along with a weapon incorporating a rocket launcher 3. Rocket launcher 3 rests on a carriage 4 and is elevated and lowered by electrically powered mechanisms 5 between it and the carriage. Carriage 4 pivots in azimuth on an intermediate structure 6 that rotates on a collar 7 on the chassis.

The illustrated weapon is an independent assembly incorporating rocket launcher 3, carriage 4, intermediate structure 6, and collar 7. The weapon is attached to chassis 1 only by a mount, and by electrical connections if any, accessible from outside the vehicle. It is accordingly possible, once the weapon mount has been released and the connections if any disconnected, for appropriate means to lift the overall weapon off of chassis 1 and load it separately onto an aircraft. Once the weapon has been lifted off, the rest of the vehicle can be loaded onto another aircraft.

One embodiment of the weapon mount that fastens the weapon to the vehicle's chassis will now be specified with reference to FIGS. 1A through 1F.

Figure 1:
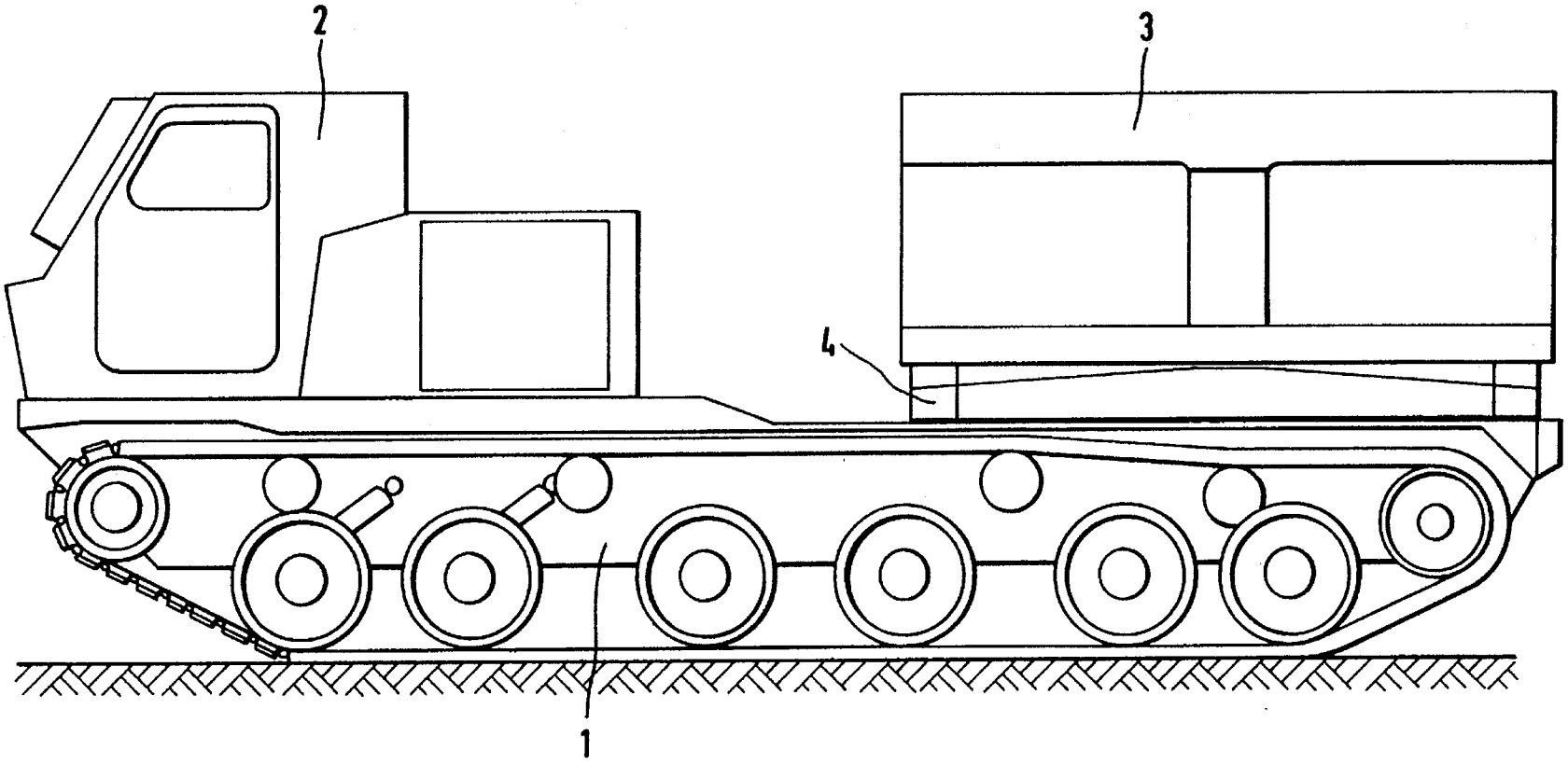
FIG. 1 is a side view of a combat vehicle with a weapon incorporating a rocket launcher mounted on it.
Figure 1A:
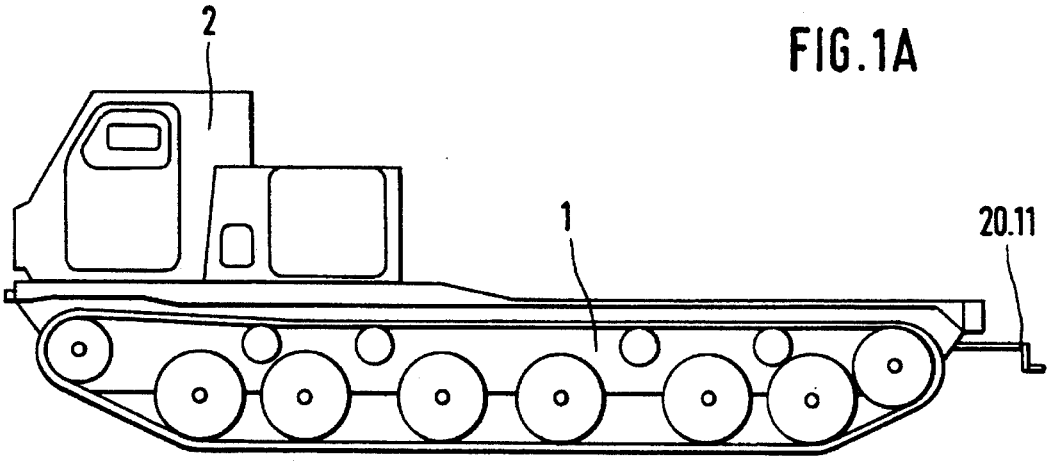
FIG. 1A is a view similar to that in FIG. 1 of the vehicle with the weapon removed.
Figure 1B:
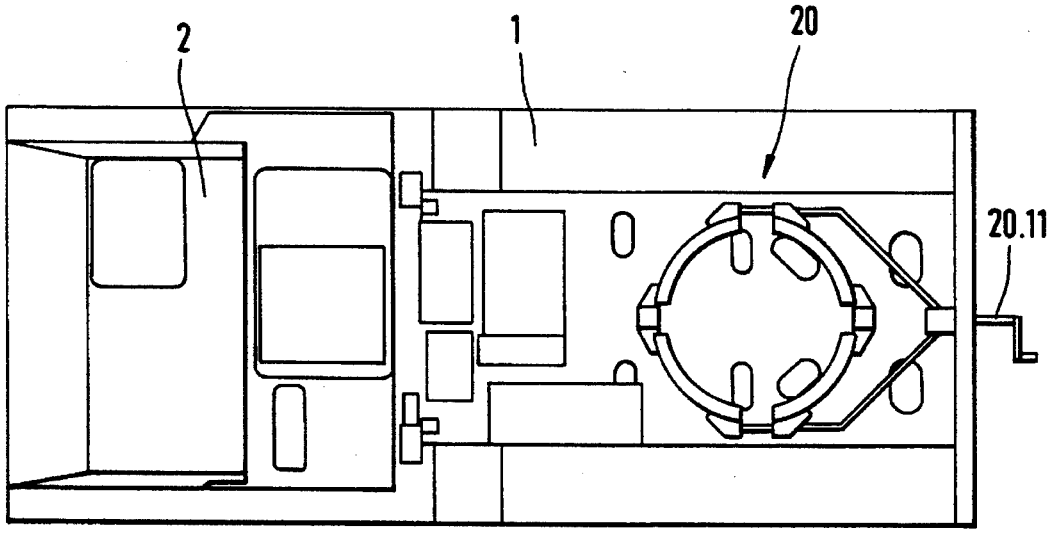
FIG. 1B is a top view of the vehicle illustrated in FIG. 1A.
Figure 1C:
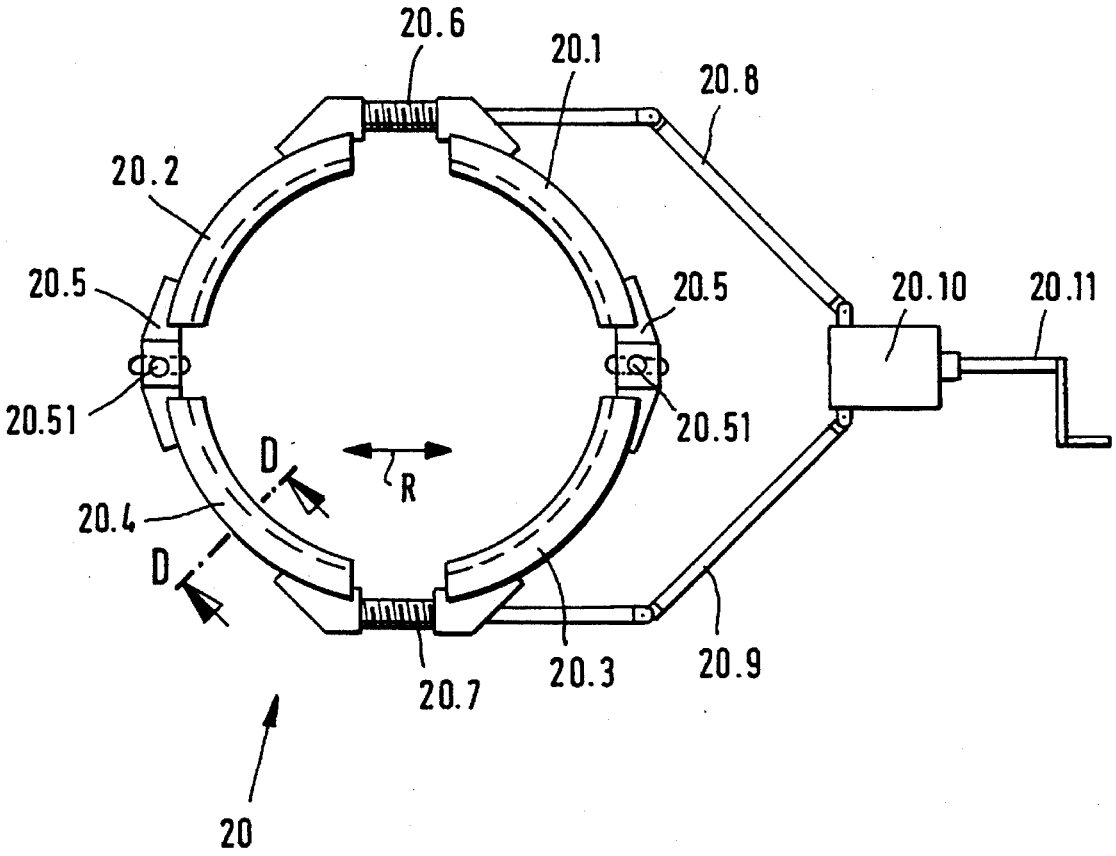
FIG. 1C is a detail of the mount on the vehicle illustrated in FIGS. 1A and 1B.

Weapon mount 20 is, as illustrated in FIG. 1B, secured to chassis 1 and is accessible from outside the vehicle by means of a manually operated crank 20.11. Mechanism 20 is illustrated in greater detail in FIGS. 1C and 1D. It incorporates four catches 20.1, 20.2, 20.3, and 20.4 in the form of annular arcs. Catch 20.1 is connected to catch 20.3 and catch 20.2 to catch 20.4 by connectors 20.5. Connectors 20.5 slide toward and away from each other in the direction paralleling the length of the vehicle and indicated by double-headed arrow R on pins 20.51 that fit into slots. The motion is generated by the mechanism that will now be specified. Catches 20.1 and 20.2 are connected by a threaded shaft 20.6 and catches 20.3 and 20.4 by a threaded shaft 20.7. Threaded shafts 20.6 and 20.7 are driven by rods 20.8 and 20.9. Rods 20.8 and 20.9 are connected to a transmission 20.10. Transmission 20.10 is driven by crank 20.11. As will be evident from the FIG. 1C, turning crank 20.11 will displace catches 20.1, 20.2, 20.3, and 20.4 toward and away from one another.

Figure 1D:
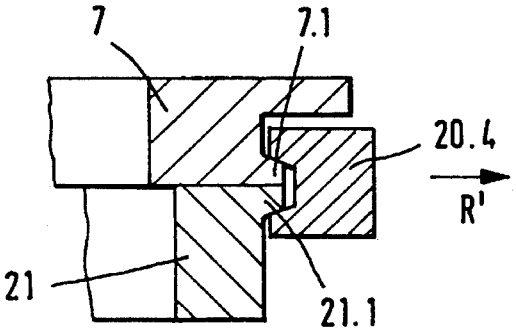
FIG. 1D is a larger-scale section along the line D—D in FIG. 1C.
Figure 1E:
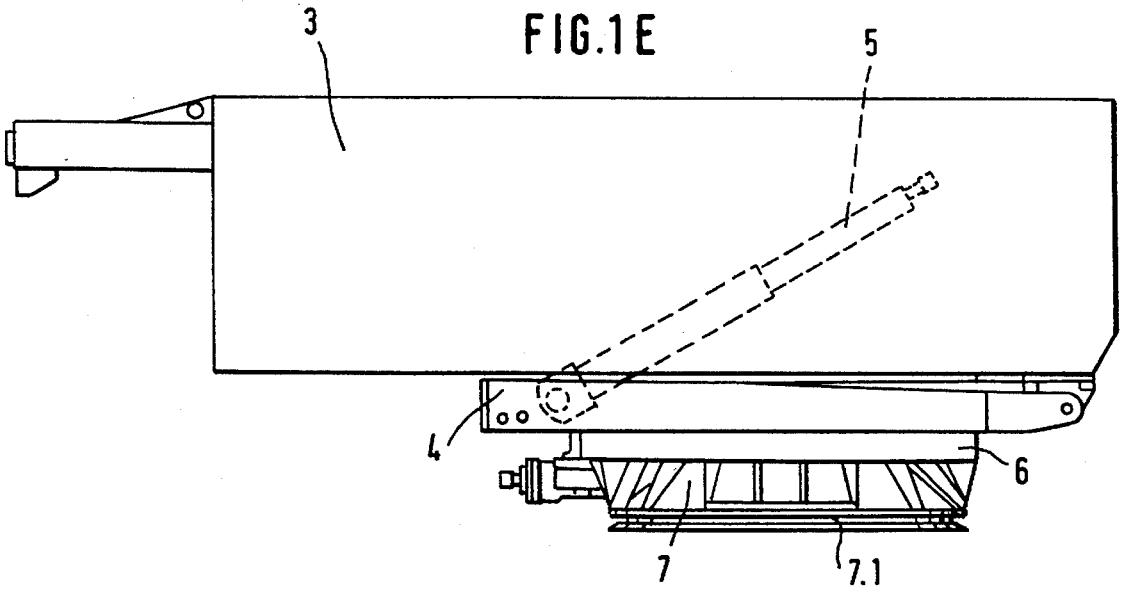
FIG. 1E is a side view of the vehicle illustrated in FIG. 1 with its weapon removed.
Figure 1F:
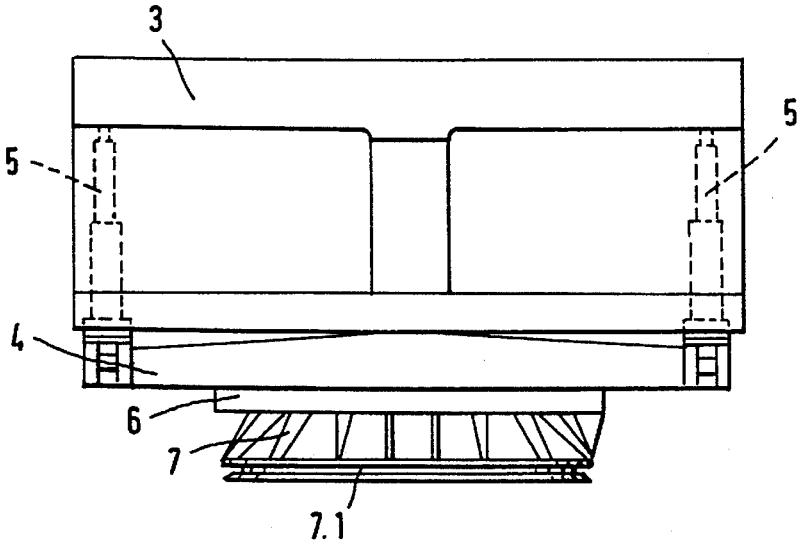
FIG. 1F is front view of the weapon illustrated in FIG. 1E.
Figure 2:
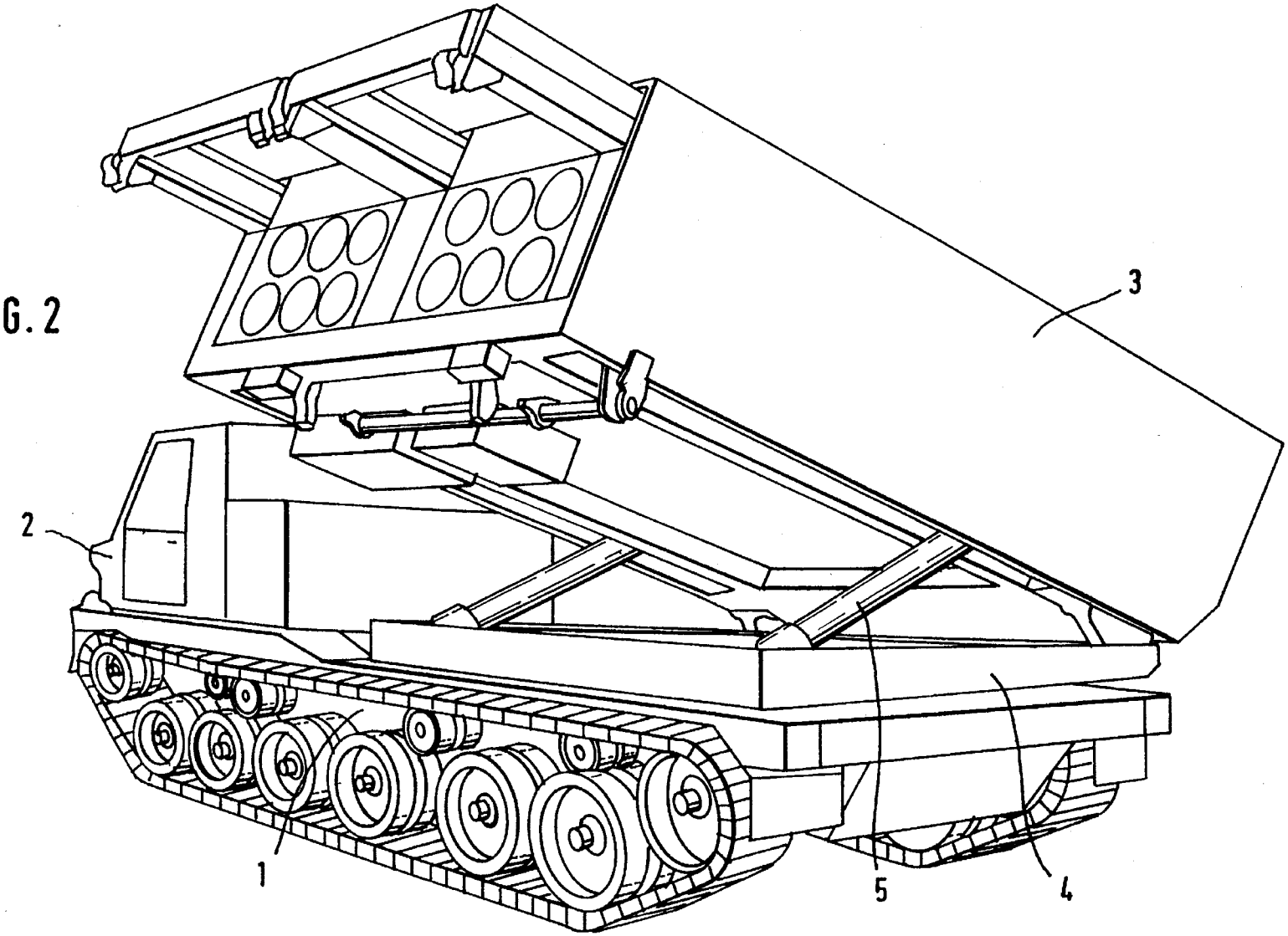
FIG. 2 is a perspective view from a rear angle of the vehicle illustrated in FIG. 1.

How the weapon is attached to the vehicle by mount 20 will now be specified with reference to FIG. 1D. Rocket launcher 3 rests on collar 7. Collar 7 rests by way of an annular flange 7.1 around its bottom against another annular flange 21.1 around a ring 21. The two flanges are clamped together by catches 20.1 to 20.4. If catch 20.4 moves out of the position illustrated in FIG. 1D in the direction indicated by arrow R' and if catches 20.1 to 20.3 move similarly, the attachment will be disestablished and rocket launcher 3 can be lifted off the vehicle.

The means and method of loading the weapon will now be specified with reference to FIGS. 3 through 9.

Figure 4:
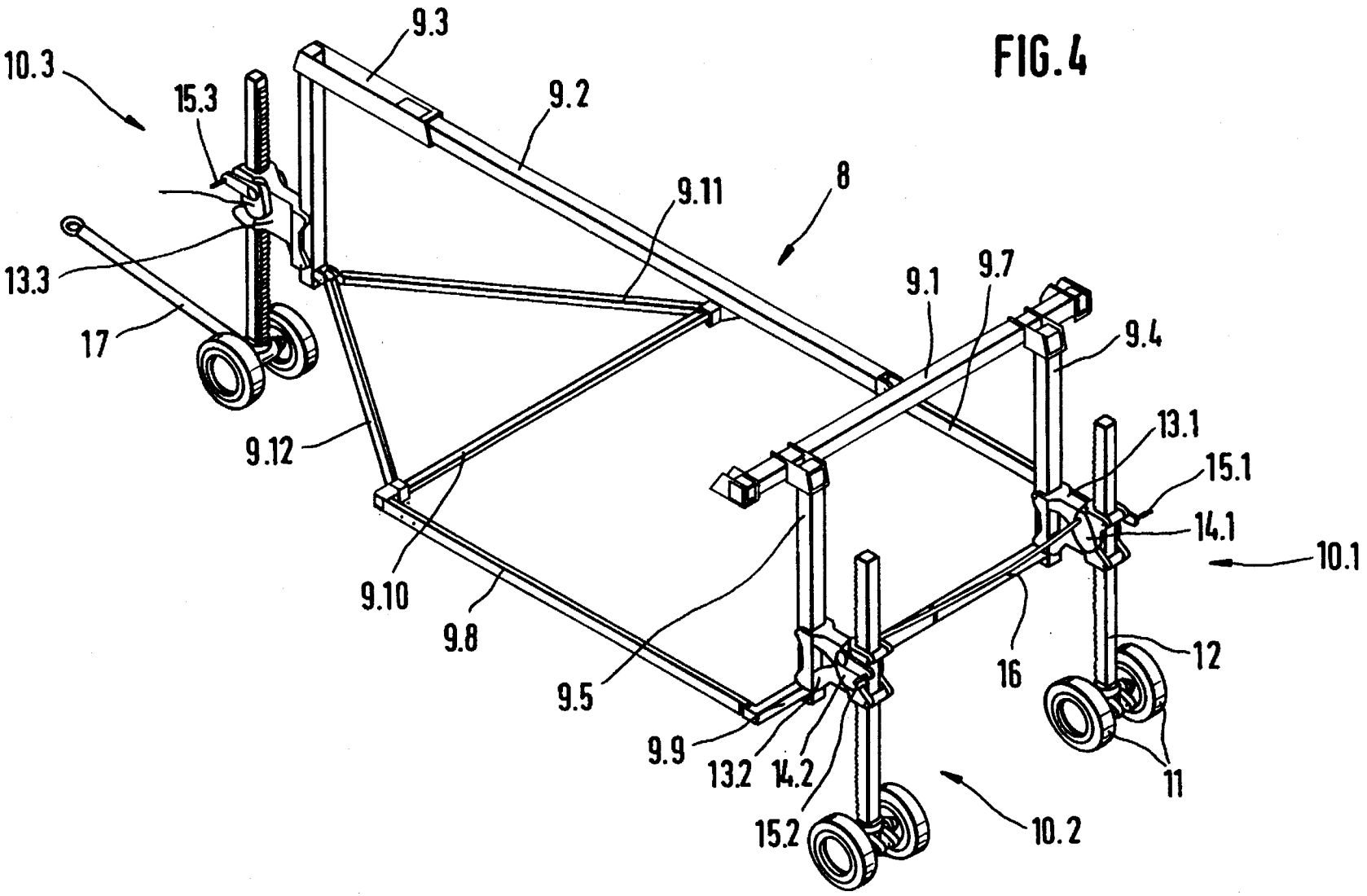
FIG. 4 is a perspective view from a rear angle of the carrier illustrated in FIG. 3.
Figure 5:
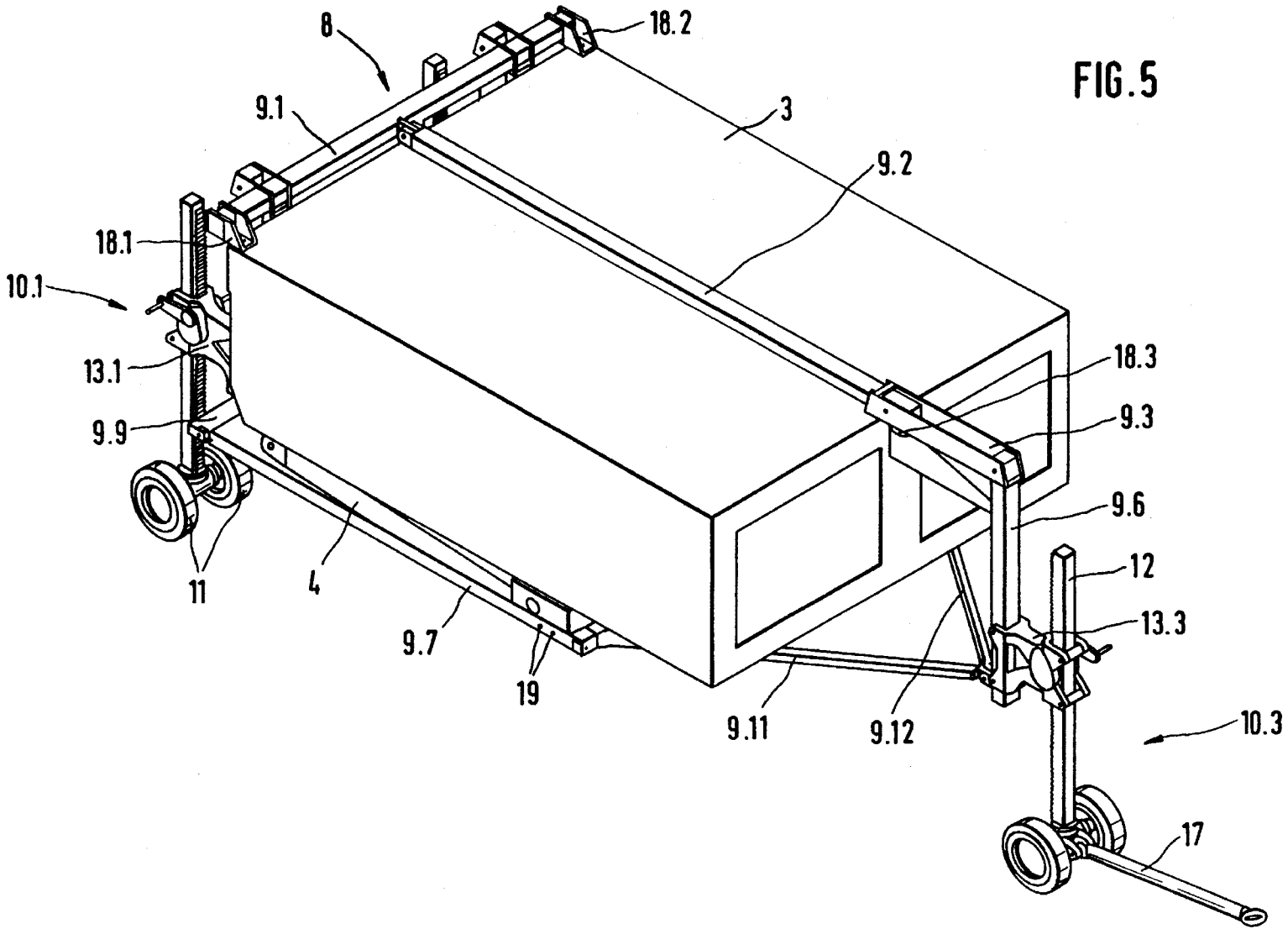
FIG. 5 is an illustration similar to that in FIG. 3 showing the weapon in the carriage.
Figure 6:
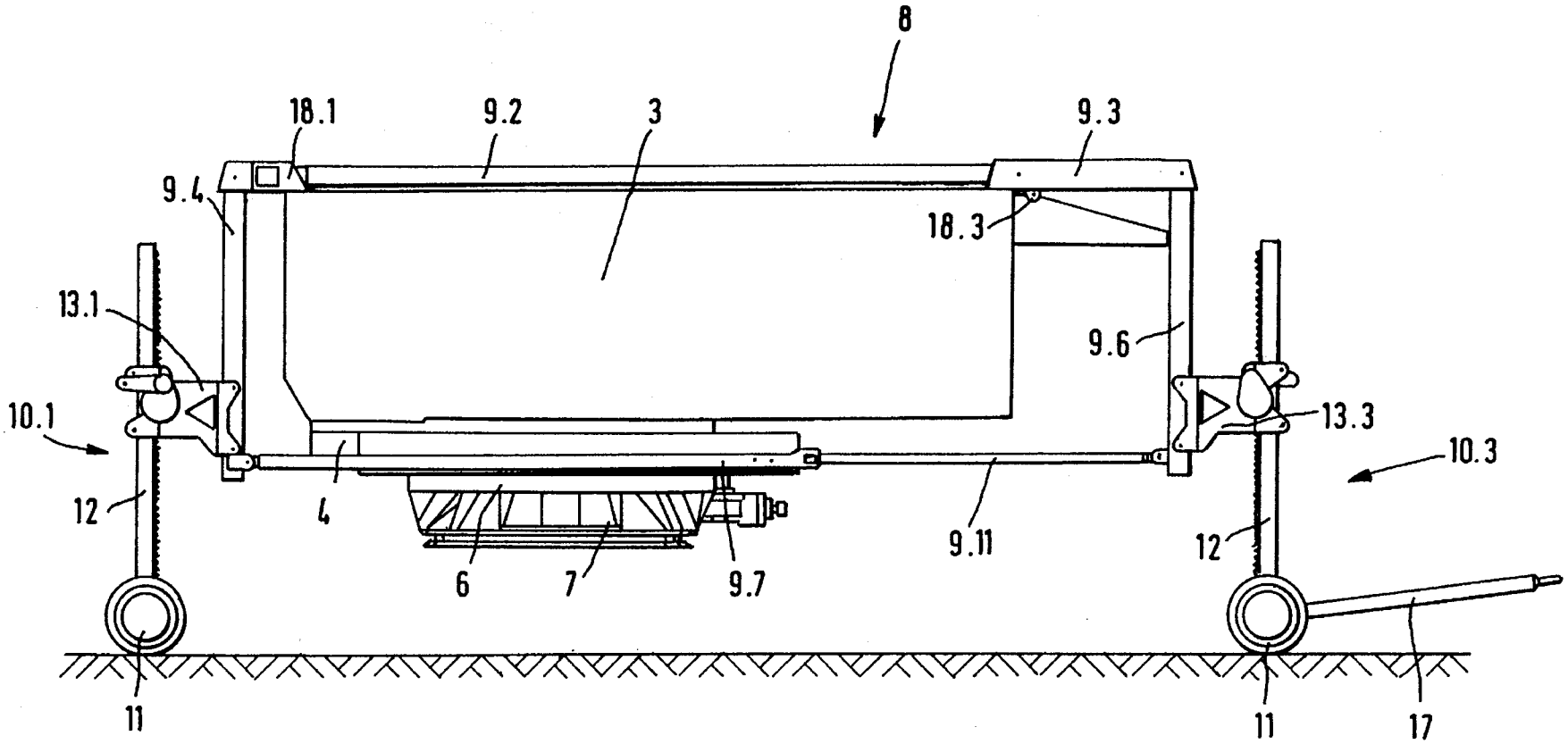
FIG. 6 is a side view of the situation illustrated in FIG. 5.
Figure 7:
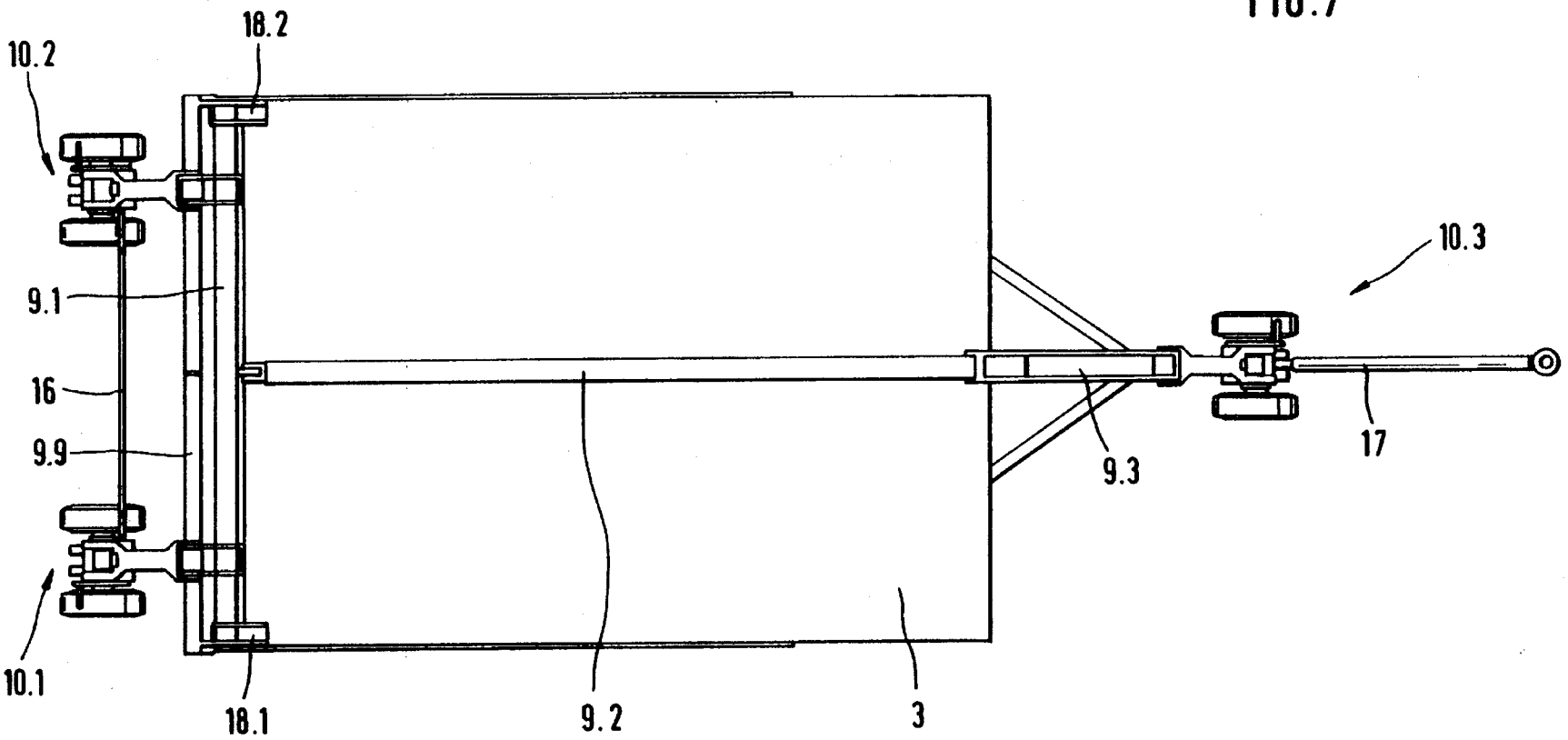
FIG. 7 is a top view of the situation illustrated in FIG. 5.
Figure 8:
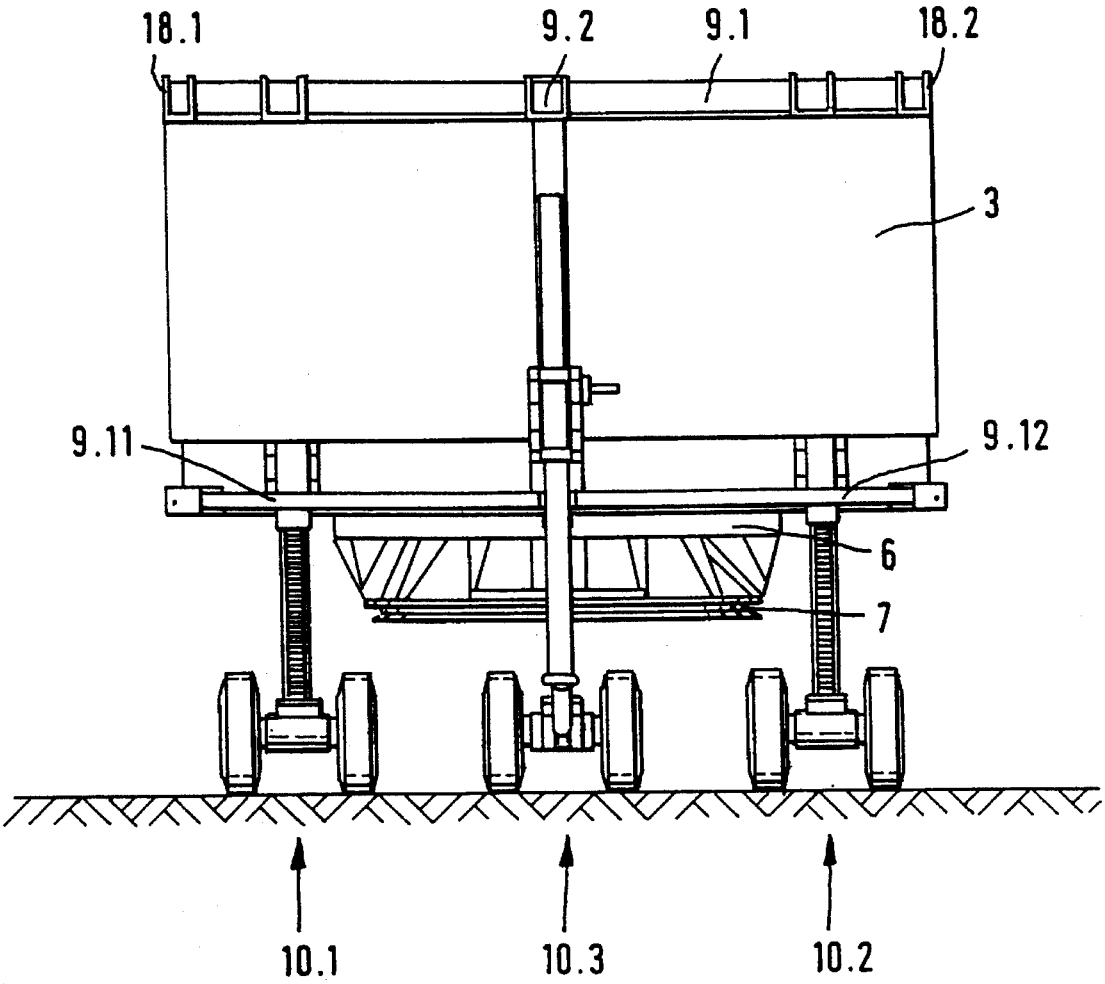
FIG. 8 is a front view of the situation illustrated in FIG.

The weapon is lifted off chassis 1 and loaded onto an aircraft by means of the carrier 8 illustrated light in FIGS. 3, 4, and 9 and loaded as shown in FIGS. 5 through 8.

Carrier 8 is a statically designed three-dimensional structure with an upper section and a lower section.

The upper section comprises a transverse strut 9.1 at the rear and a longitudinal strut 9.2. Longitudinal strut 9.2 has an extension 9.3. Transverse strut 9.1 rests by way of uprights 9.4 and 9.5 on two arms 13.1 and 13.2. Arms 13.1 and 13.2 travel up and down on upright rack-and-pinion mechanisms 10.1 and 10.2 as will be specified hereinafter. The front of longitudinal upper-section strut 9.2, extension 9.3, that is, rests by way of an upright 9.6 on another arm 13.3. Arm 13.3 travels up and down on a third upright rack-and-pinion mechanism 10.3.

The lower section is suspended from uprights 9.4, 9.5, and 9.6 and comprises two longitudinal lower-section struts 9.7 and 9.8 and two transverse struts 9.9 and 9.10. The rear of the lower section of carrier 8 is suspended from the upper section by way of uprights 9.4 and 9.5 at strut 9.9 and its front from longitudinal upper-section strut extension 9.3 by way of upright 9.6 and two horizontal braces 9.11 and 9.12 that extend from the bottom of upright 9.6 to the joint between forward transverse lower-section strut 9.10 and longitudinal lower-section struts 9.7 and 9.8.

Since both the upper and lower sections of carrier 8 are joined together out of struts and braces, they can easily be dismantled manually by two workers.

Each rack-and-pinion mechanism 10.1, 10.2, and 10.3 essentially comprises an upright 12 resting on a set of wheels 11 that roll vertically over the ground. A rack 12.1 is secured to upright 12. At least one unillustrated pinion engages each rack 12.1. Each pinion is a component of a transmission 14.1, 14.2, or 14.3. Transmission 14.1 is accommodated in or on arm 13.1, transmission 14.2 in or on arm 13.2, and transmission 14.3 in or on arm 13.3. The transmissions' intakes are connected to drive mechanisms. The drive mechanisms in the illustrated example are cranks 15.1, 15.2, and 15.3. Transmissions 14.1 and 14.2 are interconnected at the rear of carrier 8 by a flexible shaft 16 such that they can both be controlled simultaneously by either crank 15.1 or crank 15.2. The transmission 14.3 on the arm 13.3 at the front of carrier 8 can of course also be connected to the other transmissions by an unillustrated flexible shaft such that all three transmissions can be controlled from a single crank. It is obviously also possible to employ stepped motors instead of a manual crank.

How the carrier is employed to remove the weapon from the rest of the vehicle and load it onto an aircraft will now be specified with reference to FIGS. 5 through 9.

Carrier 8 is converted to the state illustrated in FIG. 9. Wheels 11 have been pivoted 90° in horizontally rotating bearings 11.1 at the bottom of each upright 12 in rack-and-pinion mechanisms 10.1, 10.2, and 10.3 to allow the carrier 8 to be displaced to one side. One of the longitudinal lower-section struts 9.7 and 9.8 has been detached. The level rocket launcher 3 is now rotated horizontally until it points at a right angle to the length of the rest of the vehicle. carrier 8 can now, as will be immediately evident from FIGS. 1 and 9, be advanced laterally over the vehicle from the rear to above rocket launcher 3. The position is illustrated in FIG. 1 and is derived from the position illustrated in FIG. 2 by leveling the rocket launcher. Once carrier 8 is positioned above the weapon, rocket launcher 3 is attached to the carrier's upper section by means of three fasteners 18.1, 18.2, and 18.3. The overall weapon is then detached from the vehicle's chassis 1 by releasing weapon mount 20 and disconnecting any electric connections. Longitudinal lower-section strut 9.7 or 9.8 is now reattached. The components of the weapon below rocket launcher 3 rest on lower section, and carriage 4 is secured to longitudinal lower-section struts 9.7 and 9.8 by bolts 19.

Rocket launcher 3 is now lifted along with the weapon's other components off chassis 1 by rack-and-pinion mechanisms 10.1, 10.2, and 10.3 in conjunction with transmissions 14.1, 14.2, and 14.3. The vehicle is now driven out forward from under carrier 8. Rack-and-pinion mechanism 10.1, 10.2, and 10.3 and transmissions 14.1, 14.2, and 14.3 now lower the upper section of carrier 8 along with the weapon to the carrying height. Wheels 11 are straightened and locked, allowing the carrier to move forward and backward. The carrier and weapon can now be towed on its three sets of wheels by way of a tongue 17 on the front.

Carrier 8, in the loaded state illustrated in FIGS. 5 through 8, can be maneuvered up to and onto an unillustrated aircraft over a conventional loading ramp and unloaded and lashed in position inside the aircraft. Chassis 1 can then be loaded in an unspecified and in itself known way onto another aircraft.

Upon arrival at their destination the vehicle and weapon can be reattached by reversing the procedure hereintofore specified.

What is claimed is:

1. A combat vehicle comprising: a chassis; a driver's cab mounted on the chassis; a weapon incorporating a rocket launcher; means mounting the rocket launcher on the chassis comprising a carriage on which the rocket launcher rests, electrically powered mechanisms between the rocket launcher and the carriage for elevating and leveling the rocket launcher and an intermediate structure that rotates on a collar on the chassis and on which the carriage is mounted for pivotal movement in azimuth, wherein the weapon is an independent assembly incorporating the rocket launcher, the carriage, the intermediate structure, and the collar and wherein the weapon is attached to the chassis only by a mount, and optionally by electrical connections accessible from outside the vehicle.

2. A method for loading the combat vehicle according to claim 1 onto aircraft, comprising the steps of rotating the rocket launcher at elevation 0° into a position 90° to the length of the vehicle, advancing a carrier that travels on at least three wheel-mounted upright rack-and-pinion mechanisms over the vehicle to above the weapon, attaching the weapon to the carrier, detaching the weapon from the chassis by releasing the mount and by disconnecting any electrical connections; lifting the weapon with the rack-and-pinion mechanisms; removing the chassis; lowering the weapon with the rack-and-pinion mechanisms to carrying height; carrying the weapon onto the aircraft by the carrier; and loading the chassis onto an aircraft.

3. A carrier for loading the combat vehicle according to claim 1, comprising a lower section, an upper section that rests on the lower section and at least three wheel-mounted upright rack-and-pinion mechanisms, wherein the upper section comprises at least one longitudinal strut and one transverse strut, fasteners for suspending the weapon for carrying from the upper section, wherein the lower section comprises at least two longitudinal struts and two transverse struts for stabilizing the carriage while the weapon is being carried, and rack-and-pinion mechanisms on which the upper section travels up and down on the lower section and sets of wheels on which the carrier travels.

4. The carrier as in claim 3, wherein at least one of the upper section and the lower section of the carrier comprise detachable struts and braces which can be disassembled.

5. The carrier as in claim 3, wherein the upper section of the carrier comprises a transverse strut at the rear and a longitudinal strut attached to the midpoint of the transverse strut, wherein the transverse strut rests by way of uprights on two arms, the arms travel up and down on upright rack-and-pinion mechanisms, an extension at the front of longitudinal upper-section strut rests by way of an upright on another arm, and said last mentioned arm travels up and down on a third upright rack-and-pinion mechanism.

6. The carrier as in claim 5, wherein the lower section is suspended from two uprights at the rear and at the front of each longitudinal strut by way of braces from the upright.

7. The carrier as in claim 5, wherein the fasteners that the weapon is suspended on the carrier from are positioned at each end of the transverse strut and at the front of the longitudinal struts on the upper section.

8. The carrier as in claim 3, wherein each rack-and-pinion mechanism includes an upright resting on a set of wheels, wherein the rack is secured to the upright, at least one pinion engages each rack, each pinion is a component of a transmission, and each transmission's intake is connected to a drive mechanism.

* * * * *